US008119946B2

(12) United States Patent
Stenzel

(10) Patent No.: US 8,119,946 B2
(45) Date of Patent: Feb. 21, 2012

(54) ELECTRICAL SWITCHING DEVICE HAVING A CONTACT PIECE WHICH CAN MOVE ALONG A MOVEMENT AXIS

(75) Inventor: Peter Stenzel, Falkensee (DE)

(73) Assignee: Siemens Aktiengesellschaft, Munich (DE)

( * ) Notice: Subject to any disclaimer, the term of this patent is extended or adjusted under 35 U.S.C. 154(b) by 510 days.

(21) Appl. No.: 12/374,010

(22) PCT Filed: Jul. 11, 2007

(86) PCT No.: PCT/EP2007/057088

§ 371 (c)(1),
(2), (4) Date: Jan. 15, 2009

(87) PCT Pub. No.: WO2008/009603

PCT Pub. Date: Jan. 24, 2008

(65) Prior Publication Data

US 2010/0072175 A1 Mar. 25, 2010

(30) Foreign Application Priority Data

Jul. 18, 2006 (DE) ..... 10 2006 033 898

(51) Int. Cl.
*H01H 33/70* (2006.01)

(52) U.S. Cl. ..... 218/68; 218/79; 218/135

(58) Field of Classification Search ..... 218/68, 218/79, 135

See application file for complete search history.

(56) References Cited

U.S. PATENT DOCUMENTS

| | | | | |
|---|---|---|---|---|
| 3,761,651 | A | 9/1973 | Fournier | |
| 4,354,072 | A * | 10/1982 | Noeske | 218/57 |
| 4,499,349 | A * | 2/1985 | Sakuma et al. | 218/135 |
| 4,528,432 | A * | 7/1985 | Senba et al. | 218/134 |
| 5,191,180 | A * | 3/1993 | Kitamura et al. | 218/135 |
| 6,875,941 | B2 * | 4/2005 | Kawamoto et al. | 218/92 |
| 7,326,865 | B2 * | 2/2008 | Ostergaard | 200/48 R |
| 2006/0124599 | A1 | 6/2006 | Braun et al. | |

FOREIGN PATENT DOCUMENTS

| | | | |
|---|---|---|---|
| DE | 7815097 | U1 | 9/1978 |
| DE | 250212 | A1 | 9/1987 |
| DE | 3224940 | C2 | 1/1988 |
| RU | 2138092 | C1 | 9/1999 |
| WO | 2004093276 | A2 | 10/2004 |

* cited by examiner

*Primary Examiner* — Truc Nguyen
(74) *Attorney, Agent, or Firm* — Laurence A. Greenberg; Werner H. Stemer; Ralph E. Locher

(57) ABSTRACT

An electrical switching device has a displaceable contact piece mounted on an encapsulated housing. The displaceable contact piece extends within and outside of the encapsulated housing. The displaceable contact piece is sealed gas-proof in relation to the encapsulated housing. For forming a gas-proof transition, first and second sealing elements are provided, which, as axial sealing elements, are alternately pressed against the encapsulated housing by peripheral collars of the displaceable contact piece. A third sealing element is provided for sealing the displaceable contact piece in a radial direction.

13 Claims, 3 Drawing Sheets

ELECTRICAL SWITCHING DEVICE HAVING A CONTACT PIECE WHICH CAN MOVE ALONG A MOVEMENT AXIS

BACKGROUND OF THE INVENTION

Field of the Invention

The invention relates to an electrical switching device having a contact piece which can move along a movement axis and is mounted on an encapsulating housing.

By way of example, an electrical switching device such as this is known from WO 2004/093276 where an electrical switching device is in the form of a grounding switch which can be used in a gas-insulated switchgear assembly. The electrical switching device is equipped with a manual drive. The movable contact piece is arranged completely inside the gas area. For this purpose, the encapsulating housing is in the form of a folding bellows in the area of the movable contact piece, resulting in the area being reversibly deformable. The folding bellows is preferably formed from a metal in order to ensure permanent gas-tightness.

In order not to tilt the folding bellows, comprehensive guidance is required for the contact piece. Furthermore, a high-quality material must be used for the folding bellows, on the one hand ensuring permanent easy deformability and on the other hand having adequate strength in order to maintain its gas-tight characteristics. A folding bellows such as this is comparatively expensive because of the specific material characteristics.

BRIEF SUMMARY OF THE INVENTION

One object of the invention is therefore to specify an electrical switching device of the type mentioned initially which can be produced at low cost.

According to the invention, this is achieved in the case of an electrical switching device of the type mentioned initially in that the movable contact piece extends inside and outside the encapsulating housing.

If the movable contact piece is arranged such that it passes through one wall of the encapsulating housing, it is possible to dispense completely with the use of a gas-tight folding bellows. The contact piece can be used to make contact with a mating contact piece which is arranged inside the encapsulating housing. The subsection of the contact piece which is arranged outside the encapsulating housing is easily accessible in order to drive the contact piece. The contact piece can be equipped with a manual drive for this purpose. However, electromagnetic, hydraulic or spring-energy storage drives as well as further drive devices can also be used.

In order to guide the contact piece, the housing may itself be designed to securely accommodate the contact piece. In this case, by way of example, a mounting may be designed in the form of a bush, with the contact piece first of all, in the area of the mounting, having an external contour which is preferably essentially rotationally symmetrical, and in particular is cylindrical. The movement axis of the contact piece is then defined as the rotation axis or axis of symmetry of the movable contact piece. However, the movable contact piece may also have a different cross section, for example oval cross sections, quadrilateral cross sections or any other polygonal cross sections. However, it is also possible, for example, for the contact piece to be in the form of a bolt, for example with a groove and a tab which engages in the groove preventing the contact piece from rotating in its mounting.

In this case, the mounting can advantageously be cast on the encapsulating housing. However, it is also possible to place a mounting, for example a collar bush, on the encapsulating housing, and to connect it thereto at a rigid angle. This can be achieved, for example, by means of a weld, a screw/riveted connection or some other suitable joining technique.

A further advantageous refinement makes it possible for the encapsulating housing to close its internal volume in a gas-tight manner from a medium which surrounds the encapsulating housing.

The provision of a gas-tight encapsulating housing makes it possible to fill the interior of the encapsulating housing with a medium, and to hold this medium in the interior. A medium such as this may, for example, be a fluid. An electro-negative gas is advantageously used, for example sulfur hexafluoride, which is at an increased pressure in the interior of the encapsulating housing. The pressure increase increases the dielectric strength of the gas. This reduces the flashover distances which need to be maintained in the interior of the encapsulating housing between assemblies which are at different electrical potentials. This therefore provides a capability to construct compact arrangements which have conductors which carry electrical potential in the interior, switching devices and further electrical devices. Furthermore, the gas-tight configuration of the encapsulating housing prevents foreign bodies from entering the interior. In this case, the ingress of gaseous foreign bodies is also virtually precluded. Particularly if the pressure in the interior of the encapsulating housing is higher than the ambient pressure, it is virtually impossible for external gases to diffuse into the interior of the encapsulating housing.

According to a further advantageous refinement, in order to seal the contact piece on the encapsulating housing, the electrical switching device has a first sealing element and a second sealing element, with the first sealing element producing its sealing effect in a first position of the contact piece, and with the second sealing element producing its sealing effect in a second position of the contact piece.

In one refinement of the contact piece according to the invention, which extends partially inside and partially outside the encapsulating housing, it is advantageous if the insertion point on the encapsulating housing has a certain degree of sealing. The sealing avoids, for example, dirt particles from entering the interior of the encapsulating housing during a switching movement. Particularly if the encapsulating housing is in the form of a gas-tight encapsulating housing, a particularly effective seal is required in order to prevent fluids which are enclosed in the interior of the encapsulating housing from escaping. The provision of two sealing elements, one of which in each case produces its sealing effect in a first position of the contact piece while the other produces its sealing effect in a second position of the contact piece, makes it possible to ensure reliable sealing of the movable contact piece.

An electrical switching device has two characteristic positions. These are, firstly, a connected position and, secondly, a disconnected position. The switching devices are typically locked in these end positions for relatively long time periods during their operation. The stationary end positions are interrupted only for relatively short time periods, in which the switching device is being moved from one of the end positions to the other end position, that is to say the time periods during which the movable contact piece is moving. It is thus advantageous for the first position to be a connected position, and for the second position to be a disconnected position (or vice versa). This means that the first sealing element has the task of providing sealing between the contact piece and the encapsulating housing in the connected position. The second sealing element has the task of providing sealing between the contact piece and the encapsulating housing in the disconnected position, that is to say in a second position of the contact piece. Since each of the sealing elements is in each case used specifically for sealing in one position, the sealing elements may be of different types in order, in particular, that their sealing effect can be matched to the requirements to be met in the respective position. In addition, it is also possible to provide for the two sealing elements to support one another in their sealing effect.

According to a further advantageous refinement, the first sealing element and the second sealing element produce their sealing effect alternately during a switching movement.

During a switching movement, the movable contact piece is moved in the mounting relative to the encapsulating housing. In this case, sections which are arranged outside the encapsulating housing in the disconnected position are inserted into the interior of the encapsulating housing, and vice versa. It is advantageous for the sealing elements to provide an appropriate sealing effect as far as possible without any interruption during the movement of the contact piece through a wall of the encapsulating housing. This can advantageously be achieved by the sealing elements producing their sealing effect alternately during a switching movement. For example, at the start of a switching movement, the first sealing element may not yet have assumed its position to produce a sealing effect, while the second sealing element is in its sealing position. As the movement progresses, it is possible, for example on reaching an end position, for the second sealing element to have no sealing effect, while the first sealing element produces a sealing effect between the encapsulating housing and the movable contact piece.

In addition, according to one advantageous refinement variant, at least one of the sealing elements rests on a collar, which is circumferential around the contact piece, in order to produce the sealing effect.

Particularly when using rotationally symmetrical contact pieces, annular sealing elements can easily rest on a circumferential collar of the contact piece. For this purpose, it is possible to provide for the collar to be machined out of the outer contour of the contact piece in the form of a projecting shoulder. However, it is also possible to provide for the contact piece to be profiled, for example having a groove or the like, which forms a circumferential collar on the contact piece. In this case, it is advantageous for the circumferential collar to be circumferential essentially transversely with respect to the movement axis of the contact piece.

According to a further advantageous refinement, the first and the second sealing element are arranged at an axial distance from one another with respect to the movement axis of the contact piece, with a third sealing element being arranged between the two sealing elements.

The axial separation of the first and of the second sealing element and the arrangement of a third sealing element between the two sealing elements make it possible to pass contact pieces through encapsulating housings when the contact pieces have to have a comparatively long travel. A long travel is associated with a long movement along the movement axis of the contact piece. Furthermore, the arrangement between the two sealing elements provides the capability both for the first sealing element to interact with the third, and for the second sealing element to interact with the third. A good seal can therefore be achieved between the contact piece and the encapsulating housing both by the third sealing element in conjunction with one of the other two sealing elements or jointly by the two other sealing elements.

In this case, for example, it may be advantageous if once the sealing effect of the first and/or of the second sealing element has been lost, the third sealing element maintains its sealing effect.

For example, the third sealing element makes it possible to end a sealing effect of the first or of the second sealing element, or else of both sealing elements, and still to ensure sealing of the contact piece, by means of the third sealing element. For example, it is thus possible to ensure sealing, in particular a gas-tight closure, between the encapsulating housing and the movable contact piece during a switching movement. While the first or the second sealing element is producing its sealing effect, it is advantageously possible to provide for the third sealing element to produce its sealing effect as well. This makes it possible to change more easily between the first and the second sealing element. In this case, there is also no longer any need to design the sealing effects of the first and of the second sealing element such that their start and end overlap in time, since use can be made of the third sealing element.

It is advantageously possible for the first and/or the second sealing element to be an axial seal.

An axial seal produces a sealing effect on the basis of a movement in the direction of the movement axis of the movable contact piece. In the simplest case, contact forces which act in the axial direction can act on the first and on the second sealing element for this purpose. Particularly when a circumferential collar is formed around the movable contact piece, this should be connected in a gas-tight manner to the contact piece, for example by being welded on or by being formed integrally with the movable contact piece. The circumferential collar is therefore moved during a movement of the contact piece in the axial direction, that is to say in the direction of the movement axis of the movable contact piece, and, for example, can press a circumferential sealing element against a section of the encapsulating housing. The sealing element produces its sealing effect at the moment of pressing on an elastomer sealing element, for example an O-ring. When an appropriate contact force is maintained, an axial seal such as this produces a sealing effect of adequate quality over relatively long time periods, for example of several months or years.

It is also advantageously possible for the third sealing element to be a radial seal.

In the case of a radial seal, the contact forces on the sealing element act radially with respect to the movement axis of the movable contact piece. The third sealing element, in the same way as the second and the first sealing element, should advantageously be arranged coaxially with respect to the axis of symmetry of the movable contact piece, which is the movement axis at the same time. For example it is possible for the third sealing element to be inserted in a circumferential groove in the mounting. In this case, the circumferential groove may on the one hand be arranged on the encapsulating housing such that the movable contact piece is arranged such that it can move relative to the third sealing element. However, it is also possible for the sealing element to be mounted in a fixed position on the contact piece. A radial seal is able to seal relative movements, for example, between the movable contact piece and the encapsulating housing. Axial movements can thus be carried out along the movement axis of the contact piece, as well as rotary movements about the movement axis, with a seal of adequate quality being provided.

It is advantageously also possible for at least one of the sealing elements to be surrounded by a reversibly deformable casing which rests on the encapsulating housing.

In order to ensure protection against influences from the area surrounding the encapsulating housing, it is advantageous for at least one of the sealing elements to be surrounded by a reversibly deformable casing. By way of example, this may be a plastic casing which surrounds that section of the movable contact piece which extends outside the encapsulating housing. In this case, this casing may extend essentially radially around the movement axis of the contact piece, and may rest on the encapsulating housing. This protects the sealing elements which are located outside the encapsulating housing against the influence of dirt. Furthermore, a surface of the contact piece which interacts with the third sealing element is protected against dirt being deposited on it. Dirt such as this could disadvantageously influence the sealing effect. By way of example, in order to allow good sliding and sealing, it is possible for the contact piece to be equipped with a sliding surface coating at least in the area between the first and the second sealing element. In order to prevent dirt and adhesion of dust and similar particles on this surface coating, the casing can be arranged at a distance from the surface of the first contact piece.

According to a further advantageous refinement, the movable contact piece makes electrically conductive contact with the encapsulating housing.

For certain switching tasks, such as grounding switching operations, it is necessary to apply ground potential to the movable contact piece. In one refinement of the encapsulating housing composed of an electrically conductive material, this housing is generally at ground potential. An electrical contact between the encapsulating housing and the movable contact piece allows the contact piece to be grounded easily. For example, for this purpose, an electrically conductive flexible strip, such as a plaited copper strip, can connect the contact piece to the encapsulating housing. This is particularly advantageous when the contact piece is guided in an electrically insulating bush in the encapsulating housing. This electrically insulating bush allows the contact piece to slide with little friction in the guide of the encapsulating housing. Furthermore, the bush allows grooves, shoulders, recesses etc. to be incorporated easily in order, for example, to provide sealing surfaces for sealing elements. Furthermore, the insulated guidance of the contact piece allows the electrical switching device to be used, for example, for test purposes, in which case the electrical connection to the encapsulating housing must be broken. The potential on the mating contact of the movable contact piece can thus be passed to the outside.

It is advantageously possible for a sliding contact arrangement to make contact between the contact piece and the encapsulating housing.

By way of example, a sliding contact arrangement has the advantage over an electrically conductive flexible strip that scarcely any additional physical space is required. Furthermore, the sliding contact arrangement can easily be used in an electrically shielded manner within the guide of the movable contact piece. For this purpose, for example, so-called contact strips can be arranged radially circumferentially around the movable contact piece. These contact strips are provided with projections which alternately make electrical contact both with the contact piece and with the encapsulating housing, and thus provide a multiplicity of contact points which ensure permanent electrical contact between the encapsulating housing and the movable contact piece, even during movement. Grooves which are introduced into the guide of the contact piece are suitable for holding contact elements of the sliding contact arrangement.

Exemplary embodiments of the invention will be described in more detail in the following text and are illustrated schematically in the figures, in which:

DESCRIPTION OF THE INVENTION

Figure 1:
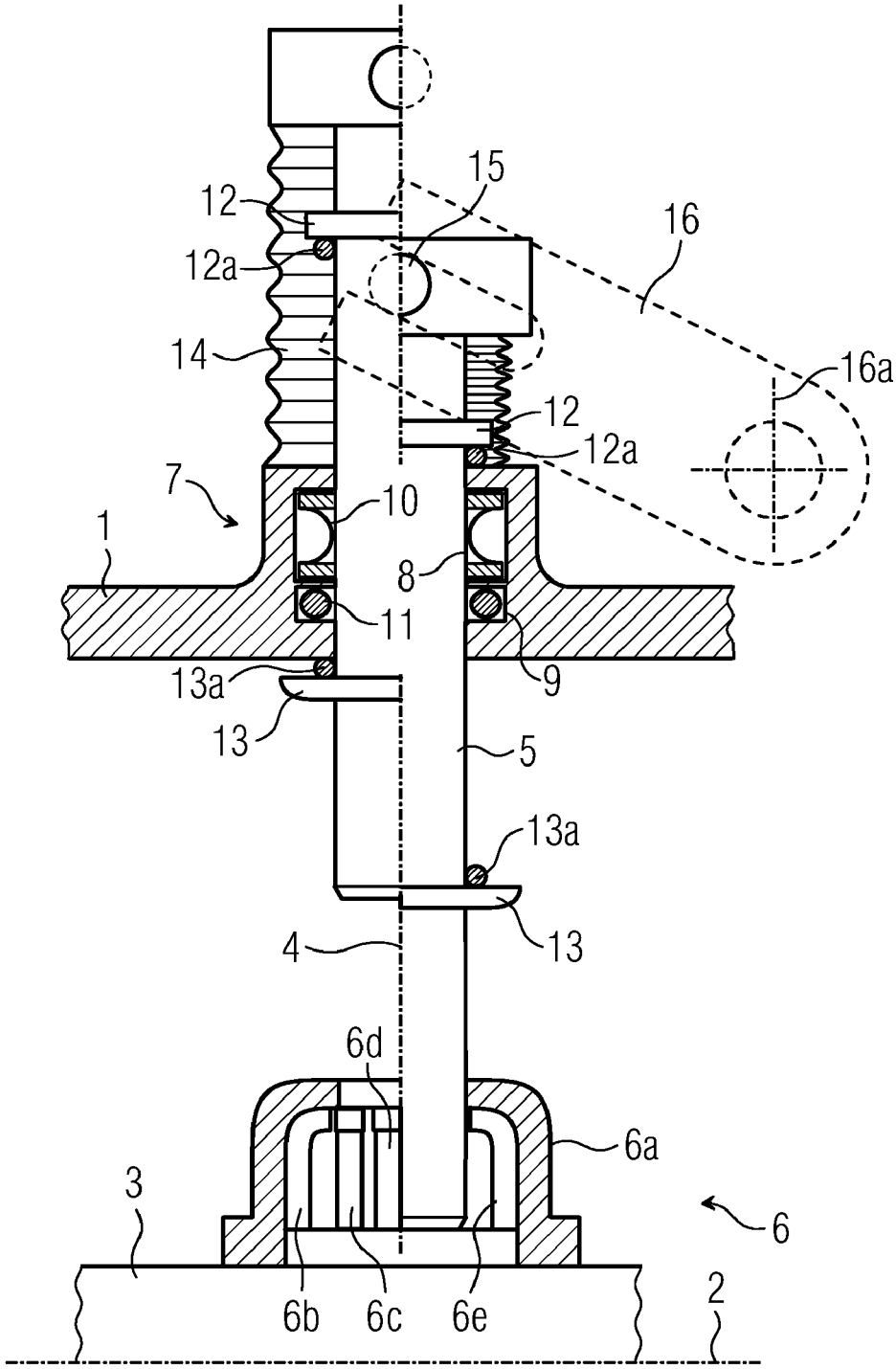
FIG. 1 shows a cross section through an electrical switching device.

FIG. 1 shows a cross section through an electrical switching device which is arranged on a gas-insulated switchgear assembly or a gas-insulated tubular conductor. The gas-insulated switchgear assembly which is illustrated by way of example in FIG. 1 has a gas-tight encapsulating housing 1. The encapsulating housing 1 is essentially tubular and encloses an electronegative gas in its interior. An electrical conductor 3 extends along a tube longitudinal axis 2 of the encapsulating housing 1. The electrical conductor 3 is provided essentially with a cylindrical external shape and is itself in the form of a hollow cylinder or a solid cylinder composed of an electrically conductive material, such as copper or aluminum. The electrical conductor 3 is arranged such that it is electrically isolated from the encapsulating housing 1. Both the electrical conductor 3 and the encapsulating housing 1 extend essentially coaxially with respect to the tube longitudinal axis 2. However, it is also possible to provide for the electrical conductor 3 not to be coaxial with respect to the tube longitudinal axis 2. This may be the case in particular when a plurality of electrical conductors, preferably of different phases of an electrical power transmission system, are arranged within an encapsulating housing 1. A movement axis 4 extends essentially radially with respect to the tube longitudinal axis 2. The movement axis 4 corresponds to the axis along which a rotationally symmetrical movable contact piece 5 can move.

As shown in the illustration in FIG. 1, the movement axis 4 divides a movable contact piece 5. The movable contact piece 5 is shown in its disconnected position on one side, and the movable contact piece 5 is shown in its connected position on the other side. In the connected position, the movable contact piece 5 has been moved into a mating contact piece 6. In the disconnected position, the movable contact piece 5 is galvanically isolated from the mating contact piece 6. The mating contact piece 6 is in the form of a tulip, that is to say a multiplicity of contact fingers 6*b*, 6*c*, 6*d*, 6*e* are arranged coaxially with respect to the movement axis 4, spring back elastically when the movable contact piece 5 is moved in, and are galvanically connected to the movable contact piece 5. The mating contact piece 6 is provided with a shroud 6*a* for holding and dielectric shielding.

In order to guide and support the movable contact piece 5, the encapsulating housing 1 is provided with a cast-on bush 7. The cast-on bush 7 forms a thickened area on a wall of the encapsulating housing 1 in the area where the movable contact piece 5 passes through. If the wall thickness of the encapsulating housing 1 is adequate, there is no need for such a casting since the wall thickness itself provides adequate support, allowing guidance of the contact piece 5. The cast-on bush 7 has a first circumferential groove 8 and a second circumferential groove 9. The grooves 8, 9 are incorporated in the running surface of the cast-on bush 7.

The first circumferential groove 8 is used to hold a sliding contact element 10 which, for example, may be formed from circumferential worm springs or a strip with stamped contact laminates. However, one essential feature for the sliding contact element 10 is that elastically deformable electrically conductive projections rest on the circumference of the movable contact piece 5 and on one surface of the first circumferential groove 8. A multiplicity of contact-making points are therefore formed and allow electrical contact to be made between the movable contact piece 5 and the encapsulating housing 1. By way of example, the encapsulating housing 1 is manufactured from electrically conductive cast metal, for example an aluminum casting, with the encapsulating housing 1 itself being at ground potential. The ground potential is also transported to the movable contact piece 5 via the contact element 10. When contact is made with the mating contact piece 6, the electrical conductor 3 is likewise at ground potential. By way of example, this makes it possible to use the electrical switching device with its movable contact piece 5 as a grounding switch in order, for example, to likewise apply ground potential to the electrical conductor 3 in the case of a safety switching operation of the gas-insulated switchgear assembly.

A third sealing element 11 is introduced into the second circumferential groove 9, which is likewise introduced into the cast-on bushes 7. The third sealing element 11 is in the form of a radial seal, that is to say sealing forces act in the radial direction with respect to the movement axis 4. It is thus possible for the third sealing element 11 to produce an adequate sealing effect during movement of the movable contact piece 5.

Furthermore, the movable contact piece 5 is provided with a first circumferential collar 12 and a second circumferential collar 13. The circumferential collars 12, 13 may be provided in different variants. For example, the first circumferential collar 12 may be in the form of a narrow cylinder, and the second circumferential collar 13 may be in the form of a narrow cylinder with rounded edges. Furthermore, further refinements of circumferential collars are also possible. For example, a collar such as this can also be formed by a reduction in the diameter of the movable contact piece 5 (cf. in this context FIG. 5). A first sealing element 12*a* is arranged circumferentially on the first collar 12. A second sealing element 13*a* is arranged circumferentially on the second collar 13. In the half of the movable contact piece 5 illustrated in the disconnected position, the second sealing element 13*a* is pressed by the second circumferential collar against the inner wall of the encapsulating housing 1. This results in an axial pressure force being applied to the second sealing element 13*a*, and deforming it. The electrical contact piece 5 is therefore sealed in a gas-tight manner with respect to the encapsulating housing 1 when it is in its disconnected position. The first sealing element 12*a* does not produce any sealing effect in the disconnected position.

The opposite situation occurs when the movable contact piece 5 is in the connected position. As can be seen in FIG. 1, in the half of the movable contact piece 5 which is illustrated in the disconnected position, the second sealing element 13*a* has been lifted off the encapsulating housing 1 and lies in an unstressed manner on the second circumferential collar 13. The first sealing element 12*a* is pressed axially by the first circumferential collar 12 against the encapsulating housing 1, to be precise against the cast-on bush 7 of the encapsulating housing 1, and thus seals the movable contact piece 5, when in the connected position, in a gas-tight manner with respect to the encapsulating housing 1. During a movement from the connected position to the disconnected position, or vice versa, the first sealing element 12*a* and the second sealing element 13*a* each interact alternately with the encapsulating housing 1, in order to ensure a gas-tight transition.

While switching from the connected position to the disconnected position, and from the disconnected position to the connected position, and during a movement which takes place during this process, the third sealing element 11 provides a seal for the movable contact piece 5. Since the third sealing element 11 is introduced as a radial seal into the second circumferential groove 9, this also results in an adequate gas-tight transition between the movable contact piece 5 and the encapsulating housing 1 during the movement. The third sealing element 11, as a radial seal, can produce its sealing effect both during axial movements and during rotary movements about the movement axis 4.

In summary, it can therefore be stated that the first sealing element 12*a*, as a surface seal, ensures a gas-tight transition when the movable contact piece 5 is in the connected position, and the second sealing element 13*a*, as a surface seal, ensures a gas-tight transition in the disconnected position and, by virtue of its configuration as a radial seal, the third sealing element 11 provides the sealing effect during a relative movement between the encapsulating housing 1 and the movable contact piece 5.

That section of the movable contact piece 5 which is arranged in the axial direction between the first and the second sealing elements 12*a*, 13*a* is the section which is arranged alternately inside the encapsulating housing 1 or outside the encapsulating housing 1. Depending on the position of the movable contact piece 5 (connected position, disconnected position, intermediate position during a movement), either the first, the second or the third sealing element 12*a*, 13*a*, 11 provides the sealing between the movable contact piece 5 and the encapsulating housing 1.

In order to prevent the ingress of dirt, that section of the movable contact piece 5 which is located outside the encapsulating housing 1 is surrounded by a casing 14. The casing 14 is, for example, a plastic which can be deformed repeatedly. The casing 14 rests on the cast-on bush 7 in the encapsulating housing 1. This ensures that the components which are provided on the movable contact piece 5 in order to make electrical contact and for sealing are protected against dust and dirt. By way of example, the casing 14 is an essentially hollow-cylindrical casing which is arranged at a distance from the contact piece 5 and rests closely on the free end of the contact piece 5, which is located outside the encapsulating housing 1.

In order to move the contact piece 5, it is possible for the contact piece 5 to be provided at its free end located outside the encapsulating housing 1 with a handle which allows the contact piece to be moved directly by hand. However, alternately, it is also possible for a bolt 15 which is located transversely with respect to the movement axis 4 to be attached to the movable contact piece 5, with a lever 16 which is mounted such that it can rotate acting on the bolt. For the sake of clarity, FIG. 1 illustrates the lever 16 which is mounted such that it can rotate in the form of an interrupted solid line. By way of example, an electrical drive can now move the contact piece 5 via a rotary mounting 16*a* of the lever 16.

Figure 2:
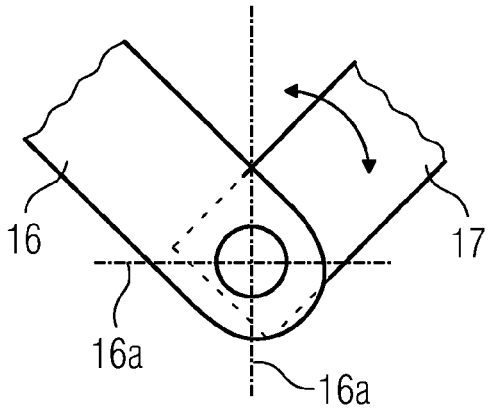
FIG. 2 shows one drive option for a movable contact piece.
Figure 3:
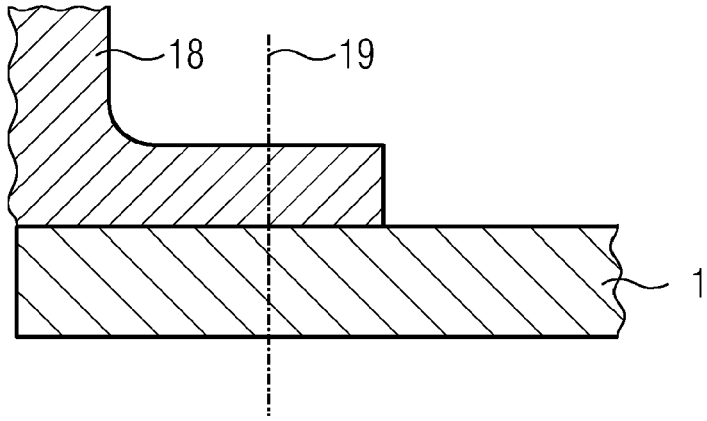
FIG. 3 shows an attachment option for a guide for the movable contact piece.

FIG. 2 shows a further variant of the drive for the movable contact piece 5 via the lever 16. The lever 16 is connected to a hand lever 17 via a shaft. A movement can also be transmitted to the movable contact piece 5 over greater distances via the hand lever 17 and the shaft. The drive forces that need to be applied by the operator can be reduced by the lever 16 and the hand lever 17 being of appropriate sizes. FIG. 3 shows a further variant of the configuration of a guide bush 18, in the form of a detail. The guide bush 18 is connected in a gas-tight manner to the encapsulating housing 1 by means of a screw connection 19 or a riveted connection, a welded connection or some other suitable type of connection. For this purpose, in addition, appropriate sealing elements can be inserted into the joining point between the guide bush 18 and the encapsulating housing 1. A configuration of a guide bush 18 such as this allows standardized encapsulating housings to be manufactured and an opening to be incorporated as required retrospectively in one wall of the encapsulating housing 1, and a guide bush 18 to be placed on one wall of the encapsulating housing 1. This allows flexible choice of the position of an electrical switching device according to the invention. Furthermore, this form of configuration of a guide bush 18 is also suitable for retrofitting to existing assemblies.

Figure 4:
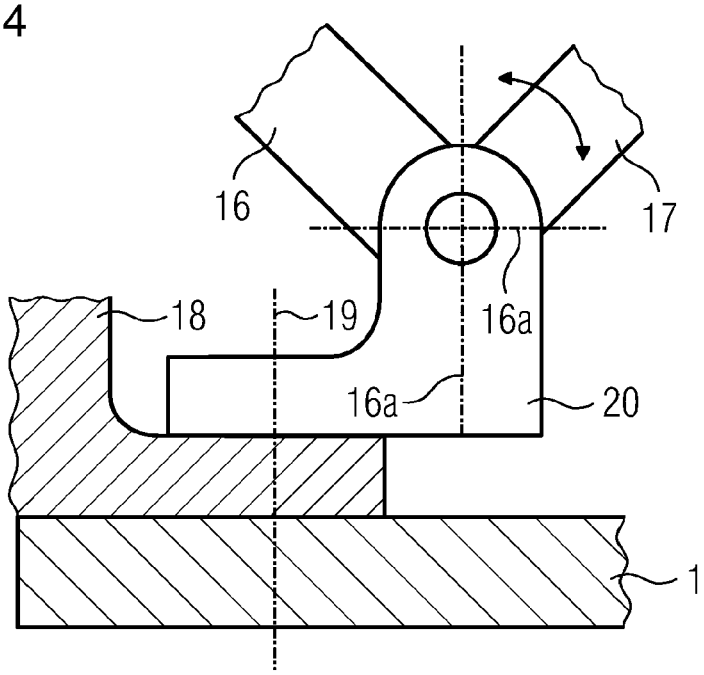
FIG. 4 shows an option for the configuration of a reversal point for a drive device, and FIGS. 5, 6, 7 and 8 each show details of the contact and sealing between a movable contact piece and an encapsulating housing.

FIG. 4 furthermore shows how, when using a guide bush 18 with a screw connection, the screw connection 19 can also be used in order to arrange a bearing block 20 at a rigid angle on the encapsulating housing 1. A lever 16 can then be mounted on the bearing block 20 such that it can rotate.

FIGS. 5, 6, 7 and 8 each show different mechanisms for making contact and for sealing between the movable contact piece 5 and an encapsulating housing 1.

Figure 5:
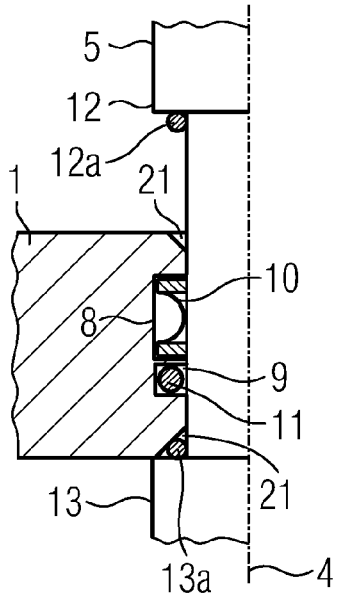

FIGS. 5, 6, 7 and 8 each illustrate the movement axis 4 and a detail of an encapsulating housing 1, with a movable contact piece 5 passing through the encapsulating housing 1. In FIG. 5, a first circumferential collar 12 and a second circumferential collar 13 are each formed by changes in diameter, that is to say the section which is arranged between the collars 12, 13 has a continuously reduced diameter. A first and a second sealing element 12*a*, 13*a* are respectively associated in fixed positions with the first and the second circumferential collar 12, 13. In order to provide sealing in the axial direction, the guide bush, which is formed in the encapsulating housing 1, is chamfered at its edges. Circumferential recesses 21 are therefore formed, into which the sealing elements 12*a*, 13*a* can be pressed. The recesses 21 result in a force being applied both in the axial direction and in the radial direction to the first and the second sealing element 12*a*, 13*a*.

Figure 6:
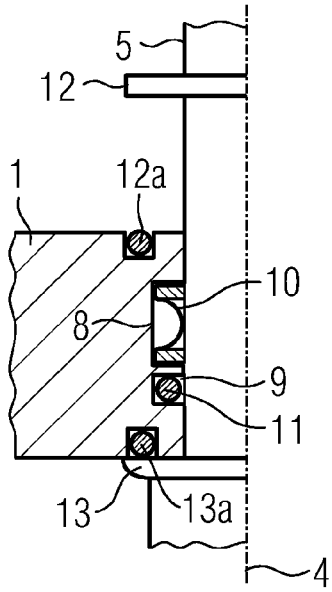

FIG. 6 shows a further option for arrangement of axial sealing elements 12*a*, 13*a*. A circumferential groove, which is completely bounded by the encapsulating housing 1, is formed at a distance from the guide bush in which the movable contact piece 5 is guided. A first and a second sealing element 12*a*, 13*a* are inserted into this groove. The sealing elements 12*a*, 13 project beyond the groove when in the unloaded state, in such a way that a sealing effect is produced between the collars 12, 13 of the contact piece 5 and the encapsulating housing 1 when the movable contact piece 5 is in the connected state and in the disconnected state.

Figure 7:
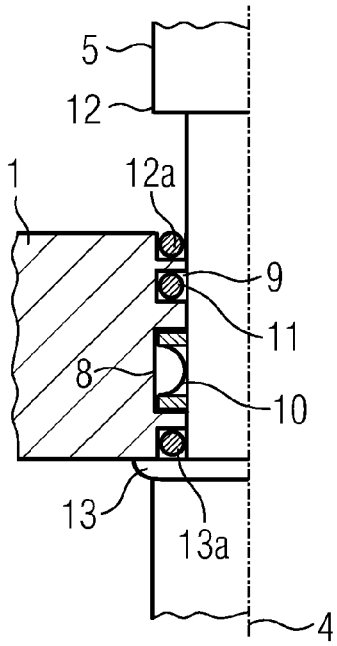

In the exemplary embodiment illustrated in FIG. 7, and in a similar manner to that in FIG. 5, a recess is provided in the edge area of the guide bush and, by interacting with the contact piece 5, forms a groove. The circumferential groove is in this case bounded on the one hand by the encapsulating housing 1 and on the other hand by the movable contact piece 5. A first and a second sealing element 12*a*, 13*a* are once again arranged in the grooves and produce a sealing effect in the connected state and disconnected state, respectively. In the case of the movable contact piece 5 illustrated in FIG. 7, a first collar 12 is formed by a change in the diameter of the movable contact piece 5. The second collar 13 is produced by a narrow ring placed on the movable contact piece 5. In contrast to the positions of the second circumferential groove 9 and of the first circumferential groove 8 shown in FIGS. 1, 5 and 6, in which the second circumferential groove 9 is arranged with the third sealing element 11 in the direction of the encapsulating housing interior with respect to the movement axis 4, in the case of the exemplary embodiment shown in FIG. 7, the third sealing element 11 is arranged, with respect to the first circumferential groove 8, with the contact element 10 in the direction of the movement axis 4 to the outside of the encapsulating housing 1.

Figure 8:
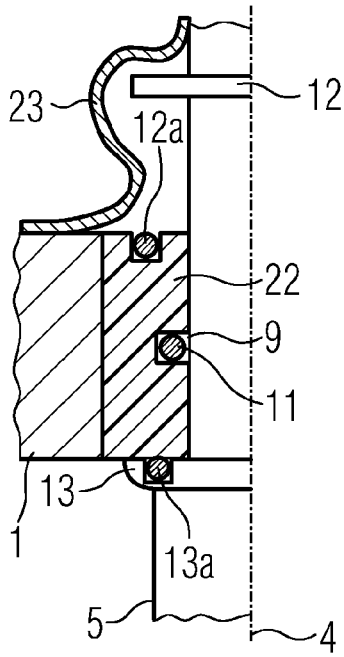

In FIG. 8, a guide bush is formed by a dielectric element 22 inserted into the encapsulating housing 1. The dielectric element 22 has a circumferential groove, which is introduced into the dielectric element 22 on the outside (with respect to the contact point of the electrical switching device), for holding the first sealing element 12*a*. Furthermore, in order to hold the third sealing element 11 and in order to provide radial contact forces on this radial sealing element, a second circumferential groove 9 is introduced in the area of the moving section of the movable contact piece 5. A third sealing element 11 is inserted there. In order to accommodate and hold the second sealing element 13*a*, the second circumferential collar 13 has a groove in which the second sealing element 13*a* is held. In order to make electrical contact between the movable contact piece 5 and the encapsulating housing 1, a flexible copper strip 23 is electrically conductively connected to the encapsulating housing 1 and to the movable contact piece 5. The flexible copper strip 23 may be detached if necessary such that, for test purposes, an electrical conductor which is arranged in the interior of the encapsulating housing 1 can be made contact with via the movable contact piece.

The exemplary embodiments shown in each of the figures can be combined with one another as required in particular with respect to the position and configuration of the circumferential collars, of the grooves, of the sealing elements, of the insulating bush, and of the electrical contact elements, etc.

The invention claimed is:

1. An electrical switching device, comprising:

an encapsulating housing;

a movable contact piece mounted to said encapsulating housing and movable along a movement axis, said movable contact piece extending inside and outside of said encapsulating housing;

a first sealing element and a second sealing element for sealing said movable contact piece at said encapsulating housing, said first sealing element being effective to produce a sealing effect in a first position of said contact piece, and said second sealing element being effective to produce a sealing effect in a second position of said contact piece, with said first sealing element and said second sealing element being configured to produce a respective sealing effect alternately during a switching movement.

2. The electrical switching device according to claim 1, wherein said encapsulating housing has an internal volume gas-tightly sealed against a medium surrounding said encapsulating housing.

3. The electrical switching device according to claim 1, which comprises a collar disposed circumferentially around said contact piece, and wherein at least one of said first and second sealing elements rests on said collar to produce the sealing effect.

4. The electrical switching device according to claim 1, wherein said first and second sealing elements are disposed with an axial spacing distance therebetween in a direction along the movement axis of said contact piece, and wherein a third sealing element is disposed between said first and second sealing elements.

5. The electrical switching device according to claim 1, wherein said third sealing element is disposed to be effective to maintain a sealing effect once the sealing effect of at least one of said first and second sealing element has been lost.

6. The electrical switching device according to claim 1, wherein at least one of said first and second sealing elements is an axial seal.

7. The electrical switching device according to claim 4, wherein said third sealing element is a radial seal.

8. The electrical switching device according to claim 4, wherein said first and second sealing elements are axial seals and said third sealing element is a radial seal.

9. The electrical switching device according to claim 1, which comprises a reversibly deformable casing resting on said encapsulating housing and surrounding at least one of said first and second sealing elements.

10. The electrical switching device according to claim 4, which comprises a reversibly deformable casing resting on said encapsulating housing and surrounding at least one of said first, second, and third sealing elements.

11. The electrical switching device according to claim 1, wherein said movable contact piece is in electrically conductive contact with said encapsulating housing.

12. The electrical switching device according to claim 11, which comprises a sliding contact assembly disposed to maintain contact between said contact piece and said encapsulating housing.

13. An electrical switching device, comprising:

an encapsulating housing;

a movable contact piece mounted to said encapsulating housing and movable along a movement axis, said movable contact piece extending inside and outside of said encapsulating housing;

a first sealing element and a second sealing element for sealing said movable contact piece at said encapsulating housing, said first sealing element being effective to produce a sealing effect in a first position of said contact piece, and said second sealing element being effective to produce a sealing effect in a second position of said contact piece; and wherein said first sealing element and said second sealing element are configured to produce a respective sealing effect alternately during a switching movement, with said second sealing element not producing a sealing effect while said first sealing element produces the sealing effect and said first sealing element not producing the sealing effect while said second sealing element produces the sealing effect.

* * * * *